US007623951B2

(12) United States Patent
Congdon et al.

(10) Patent No.: US 7,623,951 B2
(45) Date of Patent: Nov. 24, 2009

(54) MACHINE AND METHOD OF DETERMINING SUITABILITY OF WORK MATERIAL FOR COMPACTION

(75) Inventors: Thomas M. Congdon, Dunlap, IL (US); Paul T. Corcoran, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 484 days.

(21) Appl. No.: 11/399,174

(22) Filed: Apr. 6, 2006

(65) Prior Publication Data

US 2007/0239336 A1 Oct. 11, 2007

(51) Int. Cl.
*E02D 1/00* (2006.01)

(52) U.S. Cl. ..... 701/50; 404/125

(58) Field of Classification Search ..... 701/50, 701/35, 1; 73/78, 818; 404/125, 126; 250/34.8
See application file for complete search history.

(56) References Cited

U.S. PATENT DOCUMENTS 3,775,019 A * 11/1973 Konig et al. ..... 404/133.1
4,467,652 A * 8/1984 Thurner et al. ..... 73/573
5,426,972 A * 6/1995 Heirtzler et al. ..... 73/84
5,493,494 A * 2/1996 Henderson ..... 701/50
5,727,900 A 3/1998 Sandstrom
5,942,679 A 8/1999 Sandstrom
6,122,601 A * 9/2000 Swanson et al. ..... 702/137
6,188,942 B1 2/2001 Corcoran et al.
6,460,006 B1 * 10/2002 Corcoran ..... 702/137
6,741,949 B2 * 5/2004 Corcoran et al. ..... 702/167
6,859,732 B2 * 2/2005 Tritico et al. ..... 702/2
6,973,821 B2 12/2005 Corcoran
2005/0158129 A1 7/2005 Chi et al.

FOREIGN PATENT DOCUMENTS

WO WO 94/25680 11/1994

OTHER PUBLICATIONS

Gesellschaft Fur Geotechnik GmbH; Compactometer Dokumentations System; pp. 440-452, Published prior to Aug. 31, 1991.
H. Thurner, and A. Sandstrom;Continuous Compaction Control, CCC;European Workshop Compaction Of Soils And Granular Materials, Paris, May 18, 2000, pp. 237-246;Stockholm, Sweden.

* cited by examiner

*Primary Examiner*—Dalena Tran
(74) *Attorney, Agent, or Firm*—Liell & McNeil

(57) ABSTRACT

A method of operating a compactor includes determining a value indicative of a compaction state of a region of work material after each of a plurality of compactor passes, and triggering a compaction fault condition if an incipient compaction response satisfies aberrant compaction criteria. A machine includes an electronic controller configured to trigger a compaction fault condition responsively to sensor input signals indicative that aberrant compaction criteria are satisfied by an incipient compaction response of a work material.

20 Claims, 4 Drawing Sheets

Equation 1:
$$a = \frac{n\sum_{i=1}^{n} X_i' Y_i - \left(\sum_{i=1}^{n} X_i' \sum_{i=1}^{n} Y_i'\right)}{n\sum_{i=1}^{n} X_i'^2 - \left(\sum_{i=1}^{n} X_i'\right)^2} = \text{slope}$$

Equation 2:
$$b = \frac{\left(\sum_{i=1}^{n} Y_i \sum_{i=1}^{n} X_i'^2\right) - \left(\sum_{i=1}^{n} X_i' \sum_{i=1}^{n} X_i' Y_i\right)}{n\sum_{i=1}^{n} X_i'^2 - \left(\sum_{i=1}^{n} X_i'\right)^2} = \text{offset}$$

Equation 3:
$$d = \frac{n\sum_{i=1}^{n} X_i Y_i - \left(\sum_{i=1}^{n} X_i \sum_{i=1}^{n} Y_i\right)}{n\sum_{i=1}^{n} X_i^2 - \left(\sum_{i=1}^{n} X_i\right)^2} = \text{slope}$$

Equation 4:
$$a' = \frac{\left(\sum_{i=1}^{n} Y_i \sum_{i=1}^{n} X_i^2\right) - \left(\sum_{i=1}^{n} X_i \sum_{i=1}^{n} X_i Y_i\right)}{n\sum_{i=1}^{n} X_i^2 - \left(\sum_{i=1}^{n} X_i\right)^2} = \ln(a)$$

Figure 4

MACHINE AND METHOD OF DETERMINING SUITABILITY OF WORK MATERIAL FOR COMPACTION

TECHNICAL FIELD

The present disclosure relates generally to methods of operating a compactor work machine, and relates more particularly to a method of operating a compactor machine that includes determining if an incipient compaction response of a work material is aberrant.

BACKGROUND

A variety of compactor machines are in widespread use today. Conventional drum compactors, vibratory drum compactors, tamping foot, sheepsfoot, and other lugged or padfoot type compactors are used to prepare work materials for a particular end use. Whether constructing a building, highway, parking lot or compacting landfill trash, it is typically necessary to compact the work material to certain specifications to render it suitable for a particular purpose. Successful compaction of work materials such as soil, gravel, asphalt and even landfill trash may depend upon proper preparation for compaction, as well as certain inherent properties of the work material. In industry parlance, the desired nature of compacted material is generally referred to as a target compaction state.

While achievement of target compaction is often approximated by a density state of the work material, density is not always the desired quantification of quality of a work material. For example, in road construction, the ability of a work material to support a substantial load, i.e. load bearing capacity, is more relevant than a measure of density. Since load bearing capacity is much more difficult to measure, a density specification has been widely accepted in determination of compaction quality. Regardless, deviations from compaction specifications may, at best, result in wasted effort or long work delays, and at worst, can compromise the suitability of the compacted material for an end purpose such as supporting a structure or road traffic.

For example, insufficient compaction can result in unstable support as the work material settles or is penetrated by moisture, causing cracking or buckling in the compacted surface, or insufficient load bearing capacity. On the other hand, overcompaction can deform the work material from its desired condition and can even result in rebound of certain areas of the work material to a less compacted state. The presence of undetected features such as voids, rocks and intrusions of other foreign matter, or inappropriate soil types can have similarly undesirable effects.

Certain undesirable work material conditions may be detected and remedied, but often only by performing the entire compaction procedure again, or by undertaking additional processing steps such as disking the work material or spraying it with water. Other conditions such as the presence of the wrong soil type or mixture have been more difficult or heretofore often impossible to detect. The ability to predict the suitability of work material for compaction, especially for continued compaction once work has started, has thus been recognized as having tremendous potential benefit to the construction industry. It is quite obvious that recognizing compaction problems early, as well as detecting compaction problems typically hidden to an operator, offers the potential of substantially reducing costs and remedial or jobsite downtime, as well as providing for better overall compaction quality assurance.

Engineers have developed a variety of strategies over the years for evaluating compaction state of a work material after treatment with a compactor, or which attempt real time monitoring of compaction state. "Walk out" tests, wherein observation of the penetration depth of toothed wheels of a compactor are in common use. Other tests may require removal of a plug of material from an otherwise finished work surface. More highly sophisticated techniques which do not disturb the work material, such as nuclear gauges, have also been employed with varying degrees of success. While these strategies have improved compaction quality assurance as compared to mere guesswork, they are not without shortcomings.

One method known in the art for improving the efficiency and performance of compaction work is taught in U.S. Pat. No. 6,460,006 to Corcoran (hereafter "Corcoran"), entitled "System For Predicting Compaction Performance". Corcoran recognizes that compaction performance as determined, for example, from a "compaction response curve," tends to be relatively predictable for a given combination of a work material condition and compactor type. Corcoran takes advantage of this pattern in predicting a number of compactor passes needed to achieve a target compaction state. Thus, machine passes beyond a point of futility may be avoided by signaling to an operator that additional compactor passes are essentially pointless. The operator may also be alerted in situations where the predicted number of passes indicates that target compaction will likely never be achieved due to excessive moisture content, etc. While Corcoran provides a useful insight regarding work material compaction data under certain conditions, there remains room for improvement. In particular, Corcoran is most applicable where the compacted work material follows a relatively predictable compaction response. It is desirable, however, to also evaluate compaction suitability in instances where the compaction response is not necessarily well behaved. In essence, Corcoran is useful for determination that a problem exists, but does not provide an analysis of the problem.

The present disclosure is directed to one or more of the shortcomings or problems set forth above.

SUMMARY OF THE INVENTION

In one aspect, the present disclosure provides a method of operating a compactor machine including the steps of determining a value indicative of a compaction state of the region after each of a plurality of compactor passes. The determined values define an incipient compaction response of the region of work material. The method further includes the steps of determining if the incipient compaction response satisfies aberrant compaction criteria, and triggering a compaction fault condition, if aberrant compaction criteria are satisfied.

In another aspect, the present disclosure provides a work machine, including a frame having at least one rotatable compacting unit coupled therewith, and at least one sensor operable to output a signal indicative of a compaction state of a region of a work material after each of a plurality of passes across the region by the rotatable compacting unit. The work machine further includes an electronic controller coupled with the at least one sensor and configured to receive sensor inputs from the at least one sensor, defining an incipient compaction response of the region of work material. The electronic controller is further configured to trigger a compaction fault condition if the incipient compaction response satisfies aberrant compaction criteria.

In still another aspect, the present disclosure provides an electronic controller for a compactor work machine configured to determine an incipient compaction response of a region of a work material based on a plurality of compaction state sensor inputs, and configured to trigger a compaction fault condition if the incipient compaction response satisfies aberrant compaction criteria.

BRIEF DESCRIPTION OF THE DRAWINGS

FIG. 4 is a set of exemplary equations appropriate for use in certain of the steps of a control process according to the present disclosure.

DETAILED DESCRIPTION

Figure 1:
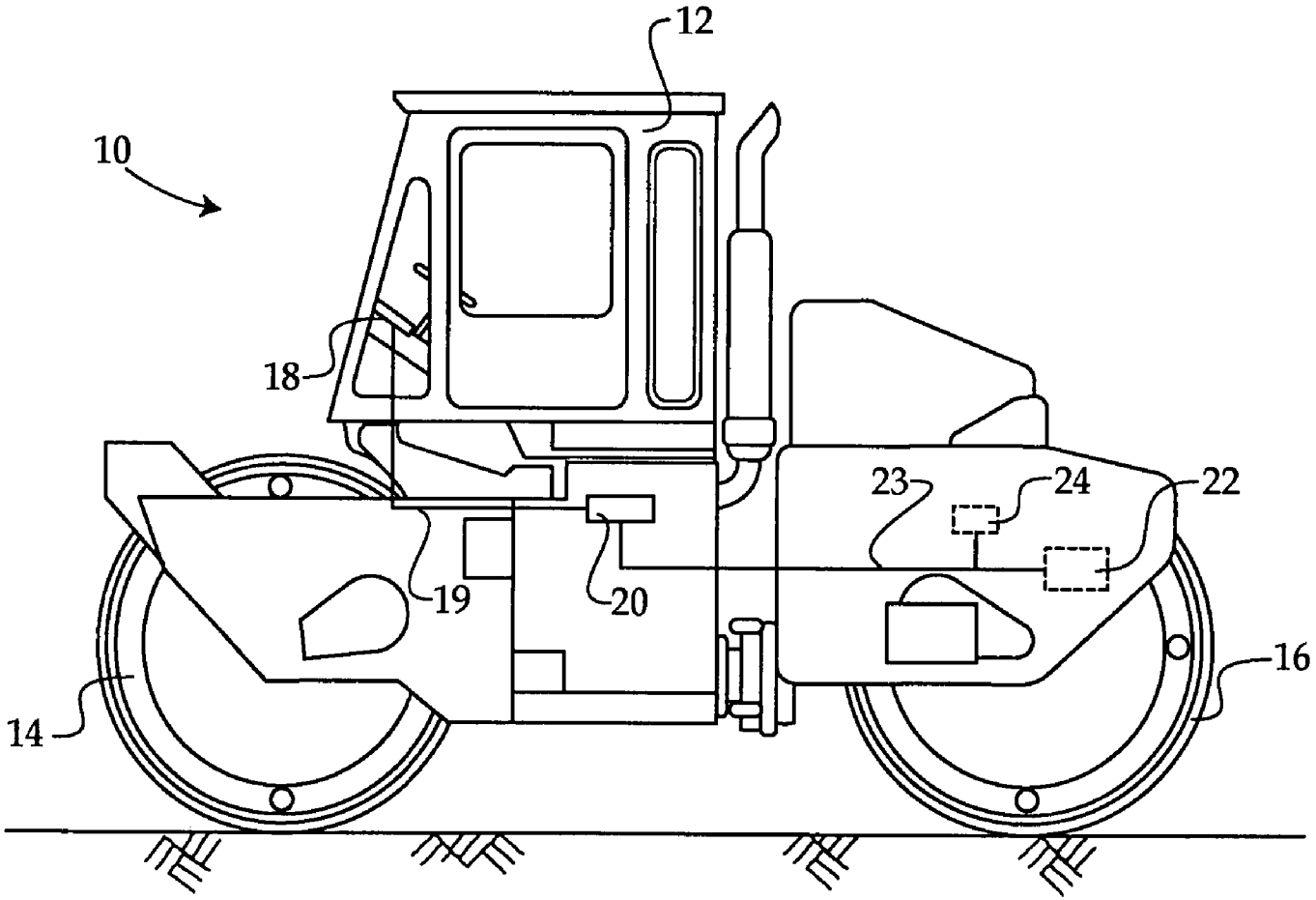
FIG. 1 is a side diagrammatic view of a compactor machine according to the present disclosure.

Referring to FIG. 1, there is shown a diagrammatic side view of a compactor machine 10 according to the present disclosure. Compactor 10 includes a body or frame 12 having front and back rotatable compacting units 14 and 16, respectively, mounted thereto. Work machine 10 further includes an operator cabin 11 mounted upon frame 12 and having a display screen 18 positioned therein for alerting an operator to various work material or work machine conditions, as described herein. Display screen 18 may be coupled with an electronic controller 20 via a communication line 19. Electronic controller 20 may further be in communication with at least one sensor 22 configured to input signals to electronic controller 20 indicative of a compaction state of a work material such that electronic controller 20 may recognize aberrant compaction criteria responsively thereto and, for example, communicate the same to an operator, as described herein. Although compactor 10 is shown in the context of a compactor machine having conventional front and rear rolling drums, it should be appreciated that the present disclosure is not thereby limited. Vibratory compactors, belted compactors, lugged compactors and virtually any other conceivable compactor machine are contemplated as falling within the scope of the present disclosure. Similarly, while self-propelled compactors having dual compacting units or drums are well-known and widely used, tow behind compacting apparatuses and compactors having a single drum or other compacting unit are also contemplated herein.

During operation, compactor 10 will typically utilize sensor 22 to communicate a compaction state of a work material to electronic controller 20. It should be appreciated that the term "work material" should be broadly construed, as the teachings of the present disclosure are considered to be generally applicable to most, if not all work material types. Moreover, descriptions herein of "soil" should not be construed in a limiting sense. Soil, sand, gravel, concrete, asphalt, landfill trash, mixtures including any of the foregoing, etc., are all contemplated as work materials suitable for compaction via the methods and apparatuses described herein.

The compaction state of interest which is monitored directly or indirectly via sensor 22 may be a relative compaction state. Relative compaction state relates to load bearing capacity of the compacted work material. Load bearing capacity thus will often, although not necessarily, be the parameter of most interest to operators and construction engineers. However, in some jurisdictions, compaction state is judged by a density measurement. In the case of paved roads and structural substrates, for example, load bearing capacity is generally considered an important parameter in evaluating the successfulness of a particular compacting operation. In other instances, for example, in compacting a work material that is intended to provide a barrier to fugitive liquids, load bearing capacity may not be considered the operative factor, though it might of course relate to the factor of interest, i.e. the capacity of the work material to serve as a liquid barrier. Relative compaction and, hence, load bearing capacity is emphasized herein, however, as load bearing capacity has been found to be a parameter having broad applicability to compactor operations.

Thus, sensor 22 may be used to input values indicative of a relative compaction state of a region of work material to electronic controller 20 after each of a plurality of passes with compactor 10, for example, an initial pass and at least one subsequent pass. In one practical implementation strategy, rolling resistance of work machine 10 may be sensed to determine relative compaction state. As compactor 10 moves across a region of work material, the energy necessary to propel work machine 10 is generally inversely proportional to the relative degree of load bearing capacity. This phenomenon is similar to the familiar relationship between the relatively greater effort needed to roll a wheel across a relatively soft substrate like sand as compared to a relatively harder substrate like concrete. As the substrate, in the present case the work material being compacted, becomes relatively stiffer, less energy is required to move the compactor. One specific means for determining the rolling resistance may include determining gross driveline energy in work machine 10, subtracting the internal losses of the machine, and further subtracting the portion of energy expended that relates to an inclination of the work surface in the particular region of interest to arrive at a net energy expended to compact the work material to a given compaction state, or "net compaction energy." To this end, sensor 22 may comprise one or more sensors, including for example a ground speed sensor and an inclinometer, configured to sense operating parameters that allow electronic controller 20 to calculate the net compaction energy. A suitable apparatus and method for this purpose is disclosed in U.S. Pat. No. 6,188,942 to Corcoran et al. Those skilled in the art will appreciate that various other means are available for directly or indirectly determining the net compaction energy imparted to the work material by compactor 10, or some other compaction state parameter of interest. For instance, rolling resistance of a hydrostatic drive compactor machine may also be used, albeit via a slightly different approach. In a hydrostatic drive machine, rolling resistance may be computed, for example, based on sensed hydraulic pressure and flow rate to give an indication of the amount of machine energy imparted to the work material.

While rolling resistance has been found to be generally inversely proportional to relative load bearing capacity, and provides one practical implementation strategy, other means for determining relative compaction state such as work material density, albeit by slightly different means, may be used without departing from the scope of the present disclosure. Where density is monitored, a density sensor, for example, utilizing radiation backscatter or electromagnetic waves, may be used. Troxler Electronic Laboratories, of Research Triangle Park, N.C. is one commercial source for suitable density measuring devices. In still further embodiments, other parameters such as fuel consumption may be used in determining the net energy required to pass compactor 10 across the work surface and, hence, indicate the relative compaction state of the work material. In still further embodiments, traditional walk out tests for density, or measurements of the depth of penetration of a tow behind device can be used to assess relative compaction. The present disclosure contemplates any compaction state measurement strategy known in the art. For instance, a relative rolling radius strategy may be used, or possibly known techniques for quantifying a sinkage deformation interaction between the compactor machine 10 and the work material.

The present disclosure further includes a method of operating a compactor machine, utilizing the aforementioned compaction state data to determine if an incipient compaction response is aberrant, for example, following an initial set of compactor passes. If aberrant compaction criteria are satisfied, work may be suspended to allow remedial actions to be taken, or to simply avoid wasted effort where additional work would be futile. The method may thus include moving compactor machine 10 across a region of work material via a plurality of compactor passes. Values indicative of compaction state of the region of work material after each of the passes, as described above, may further be determined, which define an incipient compaction response of the region of work material. The method may further include determining if the incipient compaction response satisfies aberrant compaction criteria, as described herein. If the response satisfies aberrant compaction criteria, electronic controller 20 may trigger a compaction fault condition that will allow compactor operation to be halted for a particular region, prior to attempting to reach a target compaction state. Where the work material is found to be suitable for compaction, this too may be indicated to the operator or a remote technician, for example, by triggering a compaction suitability condition.

Determination of whether the incipient compaction response satisfies aberrant compaction criteria may include fitting a compaction response curve to the determined values, also referred to herein as "data points." The compaction response curve may include, for example, a nonlinear compaction response curve. In other words, compactor 10 may be passed across a region of the work material a plurality of times, compaction state data collected and a curve fitted to the resultant data points, as described herein.

One feature of the compaction response curve which is evaluated in determining whether the incipient compaction response satisfies aberrant compaction criteria may be the slope of an initial segment of the curve. Triggering a compaction fault condition may therefore include triggering a compaction fault condition based at least in part on the determined slope. The initial segment or portion of the compaction response curve may include at least the first two collected data points, and may include the first three or four data points collected after three or four compactor passes. The slope of the initial segment of the compaction response curve may be determined by electronic controller 20 via known linear regression techniques. The slope may also be determined via a map or some other means. Thus, although the present disclosure contemplates fitting a nonlinear curve to the data points, the slope determination aspect of the present disclosure may take place via linear regression.

In application, the relative steepness of the described slope may be used to determine useful information about the work material, in particular whether the slope is different from an expected or permitted slope or slope range, and, hence, whether the incipient compaction response satisfies aberrant compaction criteria. If so, certain types of fault conditions may be triggered, as described herein. The method may further include determining a compaction suitability range for the slope of the initial curve segment. In other words, a compaction suitability range may be determined which corresponds with a suitable slope of the initial segment of the compaction response curve. Determining if the incipient compaction response satisfies aberrant compaction criteria may further include determining if the slope of the initial segment of the compaction response curve is outside of the compaction suitability range, that is, relatively steeper or shallower than the suitability range. The terms "steeper" and "shallower" are used herein in an illustrative manner only, and are applicable where the compaction response curve is a load bearing capacity, net energy, or other indication of compaction response versus compactor pass number curve. Where density, or a different compaction indication is used, use of the terms "steeper" and "shallower" might be reversed. For example, a particularly wet work material may achieve target density rather quickly but cannot achieve adequate load bearing capacity. This is because the excess moisture content provides a lubricity property that permits consolidation, and removal of air voids rather easily, however the inability of individual particles to become closely bonded prohibits adequate support of a load because of its tendency to deform. This is known in the art as 'remolding' and is easily distinguished when the compaction response is load bearing capacity or net energy. Therefore, if the work material is particularly wet, the initial segment of the compaction response curve may be relatively shallow if the compaction response is load bearing capacity or net energy, and relatively steep if the compaction response curve is density. Conversely, a particularly dry soil may exhibit a rather steep initial segment of the compaction response curve if the compaction response is load bearing capacity or net energy, and be relatively shallow if the evaluated compaction response is density. It is nevertheless contemplated that the initial slope of the compaction response curve may be used in determining whether the incipient compaction response is aberrant regardless of the type of curve fitted to the data points.

The suitability range for the described slope may depend upon the particular work material type, and may be determined empirically. A clayey soil, for example, will certainly exhibit different compaction characteristics than a sandy soil. Thus, the boundaries and breadth of the compaction suitability range for the slope of the initial segment may be different for different soil types.

Figure 3:
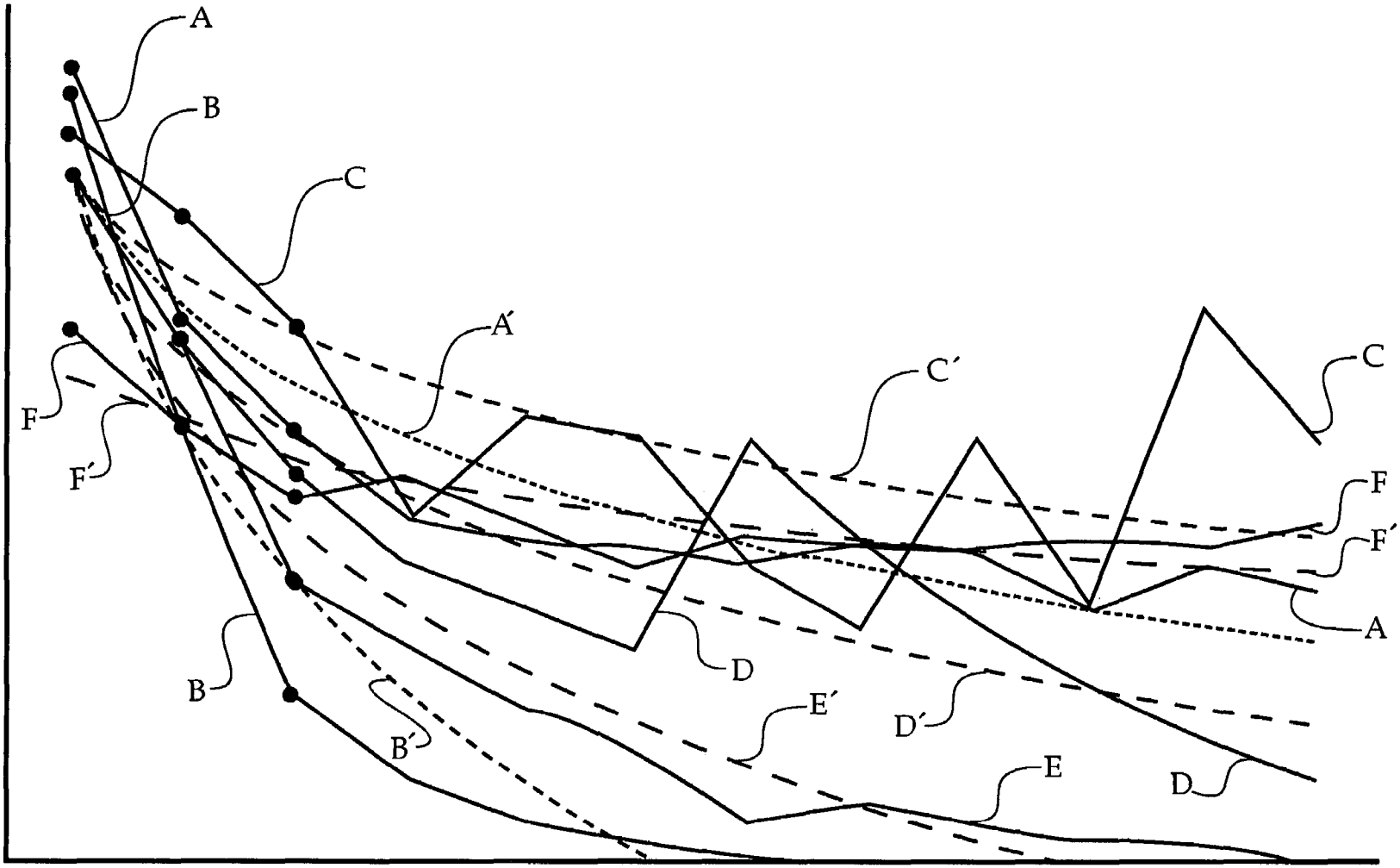
FIG. 3 is a graph illustrating curves corresponding each to a set of data points, in comparison with compaction response curves fitted to each set of data points.

Illustrative curves for net energy versus compactor pass number under different conditions are shown in FIG. 3, described below. The described slope behavior for dry soils is believed to be due at least in part to the relative ease of supporting substantial loads where moisture content is low. The absence of significant amounts of water tends to allow greater friction between the soil particles and allows air to be expelled more easily. Thus, target compaction may develop more quickly. While dry soils do appear to have relatively good load bearing capacity, they tend to be unstable over time, as moisture can penetrate the air voids and change the soil properties. For this reason it will often be desirable to detect an insufficient moisture condition of the work material, despite relatively high load bearing capacity. Therefore, if the slope of the initial segment of the compaction response curve is relatively steeper than the compaction suitability range, in this example, it may be determined that the work material has an insufficient moisture content. In such cases, electronic controller 20 may trigger a low moisture fault condition responsive to the slope being steeper than the compaction suitability range. On the other hand, where a density versus compactor pass number curve is used, the slope of the compaction response curve for a relatively dry soil may be relatively shallower than a compaction suitability range, as the lack of moisture affects the overall density of the work material.

It has further been discovered that work material having relatively low particle cohesion may often exhibit a compaction response curve having a relatively shallow initial slope, at least where the compaction response curve is a load bearing capacity versus compactor pass number curve. In other words, aberrant compaction criteria may be satisfied where the slope of the initial segment of the compaction response curve is relatively shallower than a suitability range for the slope. Such work materials can include aggregates low in fine particles and dry sands, for example. This behavior is believed to be due at least in part to the fact that the individual particles tend to stick to one another less than in wetter or otherwise more cohesive work materials, and hence, are remolded upon successive passes by a compactor. This is particularly apparent when the compaction machine is equipped with sheepsfoot or other tips on the drums, and is less apparent with smooth drum compaction machines. Constant re-manipulation of the particles tends to result in difficulty in increasing the degree to which the work material is compacted. Accordingly, where the slope of the initial segment of the compaction response curve has a slope that is shallower than the compaction suitability range, it may be determined that the work material has an unsuitable degree of cohesion and, accordingly, electronic controller 20 may trigger a low cohesion fault condition, and could be indicative that the wrong type of compaction machine is being used for the material type.

A compaction suitability range for the slope of the initial segment of the compaction response curve may be determined empirically. Test beds may be compacted under varying conditions having, for example, different moisture content or different proportions of aggregates and/or sand. A particular compaction response curve, for example a load bearing capacity versus compactor pass number curve, may then be determined for each set of soil conditions and the slope of an initial segment of the compaction response curves determined. By analyzing the slopes of compaction response curves for work material types where the moisture content or cohesion is known to be suitable, for example, a suitability range for the slope of an initial segment of the compaction response curve may be determined. The selection of the compaction machine is an important consideration in determining a suitability range for the initial slope of a compaction curve. A heavier machine, or one employing the use of a vibratory mechanism may cause the initial segment of a compaction response curve to be steeper than that of smaller or non-vibratory machines.

In other embodiments, rather than a suitability range, a particular slope value could be used as a threshold for determining whether aberrant compaction criteria are met. Stated otherwise, rather than a range, a discrete slope value might be used as a trigger for deciding "aberrant" versus "non-aberrant," or as a trigger for selection of a subsequent decision in the control process.

As stated above, in addition to the above linear regression analysis to determine slope of an initial segment of a compaction response curve, nonlinear regression may be applied to fit a nonlinear curve to the collected data points. Curve fitting of the data points may take place via a logarithmic fit method to generate a decay curve of net compaction energy or load bearing capacity versus number of compactor passes, for example via the equation:

$$Y=a\ \ln(x)+b;$$

where:

Y=net compaction energy;

a=amplitude;

b=offset;

x=number of machine passes.

To determine best logarithmic fit, variables a and b may first be determined using linear regression where net energy (Y) and number of machine passes (X) are known, for example via the linear equation:

$$Y=aX'+b;$$

where: X'=ln(x).

Next, the above equation may be solved for a and b, via equations 1 and 2 of FIG. 4, where i is a dummy variable, for example set equal to 1 for the first compactor pass, and n represents the total number of compactor passes. Once a and b are determined, the best logarithmic fit, F, may be determined via the equation: F=aln(x)+b.

An exponential fit method may also be used to generate a growth curve for compaction response, or other measures of material compaction state, such as density, where an increase of value results from successive machine passes, versus number of compactor passes, for example, via the equation:

$$Y=ae^{dx};$$

where:

Y=net compaction energy;

a=amplitude;

d=damping; and x=number of machine passes.

The variables d and a may be determined where net energy (Y) and number of machine passes (X) are known. If $Y=ae^{dx}$, then ln(Y)=ln(a)+dx. Let Y'=ln(Y) and a'=ln(a), and the following linear equation results:

$$Y'=dx+a'.$$

This equation may be solved for d and a' via Equations 3 and 4 of FIG. 4, where i is a dummy variable, for example set equal to 1, and n is the total number of compactor passes or data points. From Equation 4, $a=e^{a'}$ and hence, best fit, F, may be determined via the equation $F=ae^{dx}$. Those skilled in the art will appreciate that alternative curve fitting techniques may be used, and the aforementioned equations and curve fitting approaches are by no means limiting.

Determining if the incipient compaction response satisfies aberrant compaction criteria may further include determining the closeness of fit of the data points to the resultant compaction response curve. In one aspect, the data points may be compared with corresponding points on the compaction response curve. This may include determining a value such as an error of fit of the data points relative to the compaction response curve, for example, by calculating a sum of errors via known techniques. Triggering of a fault condition may take place responsive to the determined sum of errors, for example, or responsive to some other determined error quantity. For ease of description, the term "closeness of fit" is used herein to refer generally to the various error quantities that may be used to characterize the relationship between the compaction response curve and the data points.

While it is contemplated that electronic controller 20 may be configured to trigger a fault condition based on the determined closeness of fit, it is also contemplated that the operator or a technician could simply view a compaction response curve, and compare the compaction response curve to the calculated data points to determine whether incipient compaction response is aberrant. In other words, the closeness of fit mentioned above might be visually displayed, allowing an operator or technician to monitor compaction and decide whether work should be modified, halted or continued.

In addition to generally comparing the compaction response curve with the collected data points, the method may further include triggering one of a first and a second decision path responsively to the comparison of the determined values with corresponding points on the compaction response curve. If, for example, the closeness of fit of the compaction response curve to the determined values, is above a reference value, the method may follow a first decision path. If, however, the closeness of fit is below a given value, the method may follow a second decision path.

The first decision path, for example, may include predicting a number of compactor passes necessary to reach a target compaction state. If the predicted number of passes is above a desired number of passes, for example twenty passes, electronic controller 20 may trigger an excess moisture fault condition. Work material having excess moisture content has been found to typically exhibit a fairly high closeness of fit of its compaction response curve, and thus may not exhibit an aberrant incipient compaction response. It has been found, however, that the compaction response curve for excess moisture conditions tends to approach an asymptotic level of compaction response, at least where the compaction response is load bearing capacity or net energy, without ever reaching a target compaction state. The number of compactor passes selected as the threshold in this instance may be arbitrarily selected, based on operator preferences, or it may be selected based upon simulation or field experience. In other words, "excess" moisture content of the work material may be a moisture level that makes reaching a target compaction state impossible, but it might also be a level where the number of compactor passes necessary to reach the target compaction state is simply too high to be practicable. In general, it is believed that the excess moisture in the soil acts as an incompressible fluid that resists attempts to compact the soil to the extent desired. This behavior has been found to be particularly apparent in clayey soils.

The second decision path, where closeness of fit is below a reference value, may include determining whether the work material is in an overcompacted state. If the work material is overcompacted, it may be damaged by successive compactor passes. The work material may become brittle as it increases in density, resulting in failure, loosening or loss of compaction. Thus, if overcompaction is apparent or appears likely, operation may proceed with caution. Upon inspection of the data, it is conceivable that a maximum number of machines passes can be determined to avoid the phenomenon from recurring. If the work material is determined to not be overcompacted, electronic controller 20 may trigger an unfit fault condition. The unfit fault condition is intended as a general provision whereby otherwise unexplained inconsistency or unreliability in the compaction response of the work material suggests that work should be stopped. An unfit fault condition may be generated as the result of, for example, a boulder inadvertently included in the prepared work material, an inappropriate lift thickness for the particular compaction machine selection or some other confounding factor such as unstable base or overall unsuitable soil type. Conditions generating unfit faults are often characterized by a progression of compaction, followed by a bow wave in front of the front roller of the compactor, for example, which causes loosening, changes in lift height and often general instability of the work material.

Similar to the foregoing discussion of the slope of an initial portion of a compaction response curve, the quantified error or closeness of fit that serves as the trigger for dividing the process between the two decision paths may be determined empirically. In one embodiment a predetermined value, for example an $R^2$ value of approximately 0.85 might be used as a threshold to decide between the two decision paths. An $R^2$ value may be determined, for example, by determining the quotient of the sum of the squared errors (the difference between the actual data points and corresponding points on the compaction response curve, squared, then summed) and the sum of the squares total (the difference between the actual data points and the average of the actual data points, squared, then summed). This quotient may then be subtracted from the number 1 to give the $R^2$ value. Those skilled in the art will appreciate that a relatively higher $R^2$ value corresponds to a relatively better fit of the data points to the compaction response curve. As alluded to above, it has been discovered that the closeness of fit serves as a means for assisting in determining whether an aberrant criteria satisfying compaction response is satisfied. To empirically determine a suitable $R^2$ value for triggering one or the other of the decision paths, compaction test beds having known characteristics may be used, and compaction state data collected which correspond with a plurality of compactor passes. Compaction response curves may then be generated which correspond with data points collected for each of the compactor passes, and an $R^2$ value or range considered to distinguish aberrant from non-aberrant conditions may be determined. Similar to slope of the initial part of the compaction response curve $R^2$ may be used on its own to decide between aberrant and non-aberrant incipient compaction response conditions in certain embodiments.

It has been discovered that work material having near optimum moisture content, and high moisture content work materials, are typified by relatively high $R^2$ regression values. Low cohesion work materials in turn tend to have only moderate $R^2$ values, whereas unfit work materials tend to have relatively low $R^2$ values. Low moisture content work materials may have relatively high $R^2$ values in an initial part of the compaction response curve; however, they may tend to become less well behaved as compaction continues. While many different approaches are possible within the context of the present disclosure, the foregoing embodiments provide a practical implementation strategy for accounting for the similarities, as well as the differences, among the various different work material conditions. For example, because low moisture content work material may have relatively high $R^2$ values at least initially, initial slope may be used to detect low moisture fault conditions. Similarly, because optimum moisture and excess moisture conditions may appear somewhat similar with respect to their $R^2$ values, the number of predicted compactor passes may be used to discriminate between the two conditions, even where evaluation of the incipient compaction response would not reveal the excess moisture condition.

It should be appreciated that although the above mathematical approach to evaluating the features of the compaction response curve may provide a relatively rigorous, reliable approach, the present disclosure is not thereby limited. In light of the present disclosure, it will be apparent that generalities may exist for certain work material conditions which may be used to identify when the work material is poorly suited to compaction. Operator or technician discernible irregularities in curve shape from a relatively smooth, consistent compaction response curve may indicate that conditions are unsuitable for continued work. Similarly, markedly shallow or steep initial slopes of the compaction response curve may indicate a problem. Thus, it is emphasized that mathematically determining slope, error of fit or other features of the curve may not be necessary for a given strategy to fall within the scope of the present disclosure. Electronic control systems as well as operator or technician monitoring may be capable of recognizing problems in the compaction process without performing the illustrative calculations set forth herein.

In an alternative embodiment, rather than relying upon the closeness of fit of a compaction response curve to its set of corresponding data points, equations specific to different work material types and different conditions of work material types may be used to indicate that aberrant compaction criteria of the incipient compaction response are met. It has been discovered that at least certain soil types have inherent compaction response curves corresponding with a signature equation. For example, using multiple regression techniques, unique equations for work material conditions such as soil type, lift thickness, moisture content, etc. may be developed. Rather than relying upon $R^2$ values and initial slopes, a database of a plurality of equations might be compared with a compaction response curve developed during a compacting operation. During operation, a collected set of data points may be compared with data points predicted by a plurality of different equations stored in the database. The equation that best fits the data may then be selected, and a determination of the work material condition made based upon the equation selected. Determination of the signature equations for various work material types and conditions may be empirical. For example, a plurality of work material test beds, again having known conditions such as moisture, cohesion, composition, etc., can be compacted and data collected corresponding to compaction state after each of a plurality of compactor passes. The equations which correspond with the separate sets of data points for each test bed may then be derived, and stored in a database for later comparison with compaction response curves during compactor operation. If an equation correlates well with compaction response data, then it may be determined that the work material has certain defined characteristics, which may be unsuitable for compaction. This concept thus provides an alternative means for determining whether the incipient compaction response satisfies aberrant compaction criteria.

Any of the above compaction fault conditions may be communicated to the operator via a perceptible signal. For example, a warning light, bell, buzzer, etc. within operator cabin 11 may be activated where a fault condition is triggered. In further embodiments, the fault conditions may be represented visually to the operator on display screen 18. Display of fault conditions on display screen 18 may include displaying on a visual map a particular color corresponding to a particular fault condition of the work material in a given region. Blue might be used to represent regions of the work material exhibiting excess moisture, for example, whereas red could be used for regions with unfit fault conditions, brown for insufficient moisture fault conditions, yellow for apparent overcompaction, orange for low cohesion and gray for indeterminate. In addition to communicating such fault conditions to the operator, suitable conditions may also be displayed. For example, where a region of the work material shows no faults and therefore appears to be suitable for compaction, the corresponding region of the map might be highlighted in green. In related embodiments, regions of the work material needing attention such as disking or spraying with water could be highlighted by flashing a portion of an electronically displayed map of the jobsite.

INDUSTRIAL APPLICABILITY

During operation, compactor 10 will be passed over a region of work material plural times. During or after each compactor pass, a value indicative of the compaction state of the work material in that region will be determined via input signals to electronic controller 20 from sensor 22 and any other sensors employed. Once a sufficient number of data points are determined, electronic controller may fit a compaction response curve to the determined values and proceed in determining whether the incipient compaction response satisfies aberrant compaction criteria. If so, electronic controller 20 will trigger a fault condition that may be used to alert the operator or a remote monitor such as a project manager that the particular region of work material poses a risk of not achieving target compaction. Such an approach offers the opportunity for work to be suspended and, if desired, the problems leading to the fault condition remedied.

Figure 2:
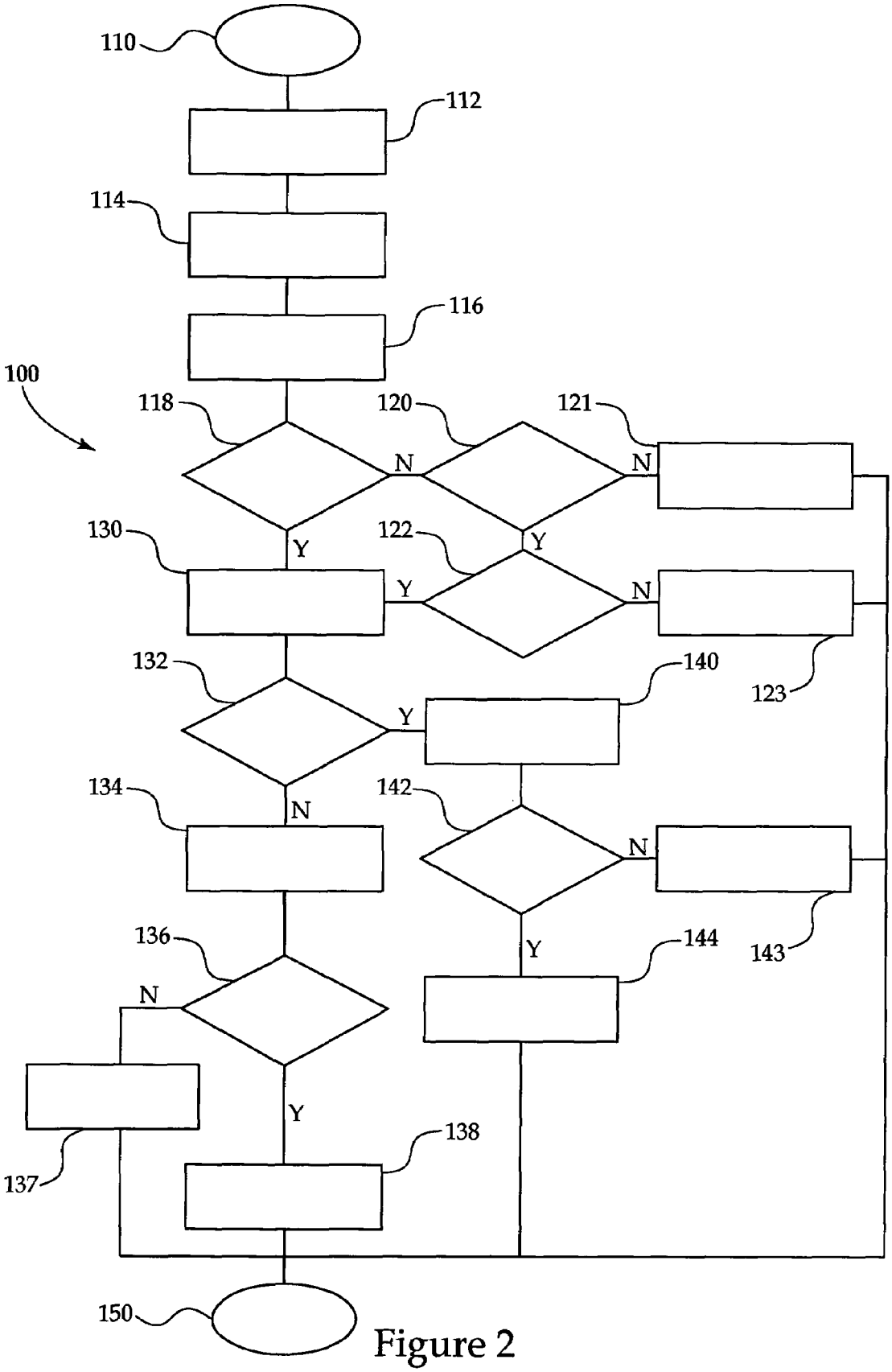
FIG. 2 is a flowchart illustrating a control process in accordance with one embodiment of the present disclosure.

Referring to FIG. 2, there is shown a flowchart illustrating an exemplary control process 100 according to the present disclosure, similar to the process described above. Process 100 will begin at a START, Step 110, and proceed to Step 112 wherein electronic controller 20 will determine values indicative of a compaction state of the work material after each of a plurality of compactor passes. From Step 112, the process may proceed to Step 114 wherein electronic controller 20 may perform a linear regression on an initial set of data points corresponding with relative compaction state of the region of work material, as determined in Step 112. From Step 114, the process may proceed to Step 116 wherein electronic controller 20 may determine a slope of a line defined by the initial set of data points as per the linear regression.

From Step 116, the process may proceed to Step 118 wherein electronic controller 20 may query whether the slope determined in Step 116 is within the compaction suitability range. If yes, then the process may proceed to Step 130. If no, the process may proceed to Step 120 wherein electronic controller 20 may query whether the determined slope is steeper than the compaction suitability range.

If at Step 120 the slope is determined to be not steeper than the compaction suitability range (and not within the compaction suitability range as per Step 118) the process may proceed to Step 121 wherein electronic controller 20 may trigger a low cohesion fault condition. If at Step 120 the slope is determined to be steeper than the compaction suitability range, the process may proceed to Step 122 wherein electronic controller 20 may query whether a vibration mode of the compactor is on. It will be recalled that the present disclosure contemplates both vibratory and non-vibratory compactors and, consequently, Step 122 may not appear in certain control schemes according to the present disclosure. If at Step 122, the vibratory mode is not on, the process may proceed to Step 123 wherein electronic controller 20 may trigger a low moisture (dry or granular) fault condition.

If at Step 122, a vibratory mode is determined to be on, the process may proceed to Step 130 wherein electronic controller 20 may perform a non-linear regression analysis on the collected data points, such as the logarithmic or exponential regression described herein. In other words, at Step 130 electronic controller 20 may perform the calculations necessary to fit a curve to the data points, and may further perform the described comparison between the data points and the corresponding points on the curve. Other strategies for evaluating the closeness of fit of the determined values to the compaction response curve might be implemented at Step 130. In the presently described embodiment, electronic controller 20 may also be thought of as calculating an error of fit at Step 130. For simplicity of description, a resultant value from Step 130 is referred to herein as closeness of fit, although those skilled in the art will again appreciate that the present disclosure should not thereby be limited.

From Step 130, the process may proceed to Step 132 wherein electronic controller 20 may query whether the closeness of fit is above a reference value. Step 132 may be understood as representing a split in decision paths for electronic controller 20 as described herein. If at Step 132, the closeness of fit is above a reference value, the process may proceed to Step 140 wherein electronic controller 20 may predict the number of compactor passes necessary to reach a target compaction state. From Step 140, the process may proceed to Step 142 wherein electronic controller 20 may query whether the predicted number of compactor passes is below a reference number. If no, the process may proceed to Step 143 wherein electronic controller 20 may trigger an excess moisture fault condition. If yes, the process may proceed to Step 144 wherein electronic controller 20 may determine that an optimum compaction condition of the work material exists.

Returning to Step 132, if electronic controller 20 determines that the closeness of fit is not above a reference value, the process may proceed to Step 134 wherein electronic controller 20 may signal the operator or a remote monitor to check for overcompaction. From Step 134, the process may proceed to Step 136 wherein electronic controller 20 may query whether overcompaction is apparent. If no, the process may proceed to Step 137 wherein electronic controller 20 may trigger an unfit fault condition. If yes, the process may proceed to Step 138 wherein electronic controller 20 may signal that compaction may proceed with caution. From any of Steps 121, 123, 138, 143 and 137 the process will typically proceed to FINISH, at Step 150.

Referring to FIG. 3, there is shown a logarithmic regression graph illustrating compaction response curves for a variety of work material conditions compared with the curves defined by the actual data points to which the compaction response curves are fit. In the graph of FIG. 3, the Y axis represents net energy and the X axis represents compactor pass number. The curves illustrated in FIG. 3 may differ from a load bearing capacity versus compactor pass number curve, described above, however, the illustrated principles are substantially the same. Load bearing capacity should be understood as increasing as the position on the Y axis decreases. Thus, the initial data point of each curve is relatively high on the Y axis and decreases toward a maximum load bearing capacity as the respective curves approach the X axis. The maximum load bearing capacity selected as the zero point of the Y axis may correspond with hardened concrete, for example.

Curve E connects data points collected during compacting of a work material under conditions considered optimum for compaction, and is characterized by an $R^2$ value of about 0.96, reflecting a relatively high closeness of fit. Curve E' represents the compaction response curve fit to the same set of data points. It will be noted that curve E' appears to fit relatively well with curve E, and more or less regularly approaches the X axis as compactor pass number increases. The initial slope of each of curves E and E' is relatively intermediate the slopes of the other curves.

Curve A connects data points developed during compacting of a work material considered to have excess moisture. Curve A' represents a compaction response curve that is fit to the same set of data points. The error of fit of the data points of curve A to curve A' is characterized by an $R^2$ value of approximately 0.85. It may be noted that the initial slope of curves A and A' is also relatively intermediate the slopes of the other curves, however, curve A' does not regularly approach the X axis as compactor pass number increases. Rather, curve A' appears to approach an asymptotic level that is above the X axis, as might be expected where excess moisture in the work material resists further compaction. Excessively sandy soils and highly organic soils may exhibit similar behavior.

Curve B connects data points developed during compacting of a work material considered to have insufficient moisture. Curve B' represents a compaction response curve that is fit to the same set of data points. The error of fit of the data points of curve B to curve B' is characterized by an $R^2$ value of approximately 0.93. It may be noted that the initial slope of curves B and B' is relatively steep compared to the slopes of the other curves, and that curve B' approaches a relatively high level of load bearing capacity in a relatively low number of compactor passes. As discussed above, however, while dry work material tends to have good load bearing capacity, its properties may change over time as moisture penetrates.

Curve C connects data points developed during compacting of a work material considered to be unfit, as described herein. Curve C' represents a compaction response curve that is fit to the same set of data points. The error of fit of the data points of curve C to curve C' is characterized by an $R^2$ value of approximately 0.4861, as might be expected where unfit conditions such as unstable base, excess lift thickness or unsuitable soil types are present. It may be noted that the initial slope of curves C and C' is relatively shallow compared to the slopes of the other curves, however, the relative steepness or shallowness of the initial slope may depend upon the particular type of unfit condition that is present. For example, if a soil having excessive granular materials were inadvertently provided, the initial slope might be relatively steeper.

Curve D connects data points developed during compacting of a work material considered to reach an overcompacted state. Curve D' represents a compaction response curve fit to the same set of data points. The error of fit of the data points of curve D to curve D' is characterized by an $R^2$ value of approximately 0.81. It may be noted that the data points of curve D have a moderately good fit relative to curve D', however, curve D exhibits erratic behavior as compaction progresses, hence, the suggestion herein that a check for overcompaction may be desirable under certain conditions, and continued work should take place cautiously if the appropriate indicators of apparent overcompaction are present. Upon inspection of a historic compaction response curve, it will become known the number of machine passes in which this condition occurs, and thus recurrence be avoided.

The present disclosure represents an insight previously lacking in the art. While determining and evaluating compaction response curves to improve compaction performance has been known for some time, engineers have heretofore failed to recognize that certain characteristics of compaction response curves under unsuitable compaction conditions can be leveraged to recognize potential compaction problems in real time, and before completion of a particular compaction job. By analyzing compaction response curves, in particular the incipient portions, under unsuitable conditions, certain features such as slope and closeness of fit, may be used in a previously unknown manner to evaluate suitability of the work material for compaction. The ability to recognize unsuitable, aberrant conditions early on promises to reduce wasted effort, as well as reducing costs and optimizing compaction quality assurance. In view of the present disclosure, those skilled in the art will appreciate that determining an incipient compaction response satisfies aberrant compaction criteria means determining the incipient compaction response is not well-behaved, and thus subsequent compaction of the material will not likely be predictable. While it is contemplated that the presently disclosed process will typically be used during operation of a compactor, it should be appreciated that at least certain aspects might be carried out apart from operation of the compactor machine. While it will typically be desirable to monitor compaction in real time, evaluation of the compaction state data might take place independently, for example, by a technician evaluating compaction data with an onsite or offsite computer. In addition, compaction data may be collected via a sensor(s) not associated with the compaction machine 10.

The present description is for illustrative purposes only, and should not be construed to narrow the breadth of the present disclosure in any manner. Thus, those skilled in the art will appreciate that various modifications might be made to the presently disclosed embodiments without departing from the intended spirit and scope of the present disclosure. While it is contemplated that the foregoing method may be implemented where both closeness of relative fit of a compaction response curve and initial slope are evaluated, each of these strategies may be applied independently. There may be instances where the risk of certain unsuitable conditions are not of primary concern due to the work material type or operating environment. For example, in certain cases the sole risk of an operation's failure might be insufficient moisture in the work material. In such a case, a method according to the present disclosure might dispense with determining the closeness of fit altogether, and focus only on identifying insufficient moisture conditions by determining a slope of the initial portion of a compaction response curve. Those skilled in the art will further appreciate that the specific conditions which risk ruining a compaction job may depend on a multiplicity of factors such as work material type, climate, reliability of work material uniformity, etc.

The specific features of the compaction response curves that are susceptible to evaluation may in turn vary based on various factors. Certain soil types might exhibit little variation in initial slope of the compaction response curve where moisture content changes. Under such conditions, other aspects of the compaction response curve than those discussed herein might be studied to allow the moisture content to be determined, for example. It will thus be apparent that applicants' insight regarding the use of compaction response data are not limited to the specific embodiments disclosed herein. Other aspects, features and advantages will be apparent upon an examination of the attached drawings and appended claims.

What is claimed is:

1. A method of operating a compactor machine comprising the steps of:

determining a value indicative of a compaction state of a region of work material after each of a plurality of compactor passes, the determined values defining an incipient compaction response of the region of work material;

determining if the incipient compaction response satisfies aberrant compaction criteria; and triggering a compaction fault condition, if aberrant compaction criteria are satisfied.

2. The method of claim 1 further comprising the step of moving the compactor machine across the region of work material via a plurality of passes, wherein the step of determining a value indicative of a compaction state includes sensing values indicative of relative compaction during each of said compactor passes.

3. The method of claim 2 wherein the step of determining a value indicative of a compaction state includes sensing a rolling resistance of the compactor machine during each of the passes across the region of work material.

4. The method of claim 2 wherein the step of determining if the incipient compaction response satisfies aberrant compaction criteria comprises the step of fining a compaction response curve to the determined values.

5. The method of claim 4 wherein fitting a compaction response curve to the determined values comprises fining a nonlinear compaction response curve.

6. The method of claim 4 wherein:

the step of determining if the incipient compaction response satisfies aberrant compaction criteria comprises a step of determining a slope of an initial segment of the compaction response curve; and the step of triggering a compaction fault condition comprises triggering a compaction fault condition based at least in part on the determined slope.

7. The method of claim 6 further comprising the step of determining a compaction suitability range for the slope of the initial curve segment, wherein the step of determining if the incipient compaction response satisfies aberrant compaction criteria comprises determining if the slope of the initial curve segment is outside of the compaction suitability range.

8. The method of claim 7 wherein the step of triggering a compaction fault condition comprises triggering a low cohesion fault condition, including a step of determining the slope of the initial segment of the compaction response curve is shallower than the compaction suitability range, where the compaction response curve is a load bearing capacity versus compactor pass number curve.

9. The method of claim 7 wherein the step of triggering a compaction fault condition comprises triggering a low moisture fault condition, including a step of determining the slope of the initial segment of the compaction response curve is steeper than the compaction suitability range, where the compaction response curve is a load bearing capacity versus compactor pass number curve.

10. The method of claim 4 wherein:

fining a compaction response curve to the determined values comprises fining a nonlinear compaction response curve; and the step of determining if the incipient compaction response satisfies aberrant compaction criteria further comprises a step of comparing the determined values with the compaction response curve.

11. The method of claim 10 wherein the step of comparing the determined values with the compaction response curve includes comparing the determined values with corresponding points on the compaction response curve, including a step of calculating a sum of errors.

12. The method of claim 10 further comprising the step of triggering one of a first and a second decision path responsively to a comparison of the determined values with corresponding points on the compaction response curve.

13. The method of claim 12 further comprising the step of estimating a number of compactor passes necessary to achieve a target compaction state, if the first decision path is triggered.

14. The method of claim 13 further comprising the step of triggering an excess moisture fault condition, including the step of determining the estimated number of compactor passes necessary to achieve the target compaction state exceeds a desired number.

15. The method of claim 12 wherein:

the step of determining whether the incipient compaction response satisfies aberrant compaction criteria includes a step of determining whether the work material is in an overcompacted state, if the second decision path is triggered; and the step of triggering a compaction fault condition comprises triggering an unfit compaction fault condition, if the work material is not in an overcompacted state.

16. The method of claim 4 further comprising the step of comparing the compaction response curve with at least one reference curve defined by an equation associated with aberrant compaction criteria.

17. A machine comprising:

a frame having at least one rotatable compacting unit coupled therewith;

at least one sensor operable to output a signal indicative of a compaction state of a region of a work material after each of a plurality of passes across the region by said rotatable compacting unit; and an electronic controller coupled with said at least one sensor and configured to receive sensor inputs from said at least one sensor defining an incipient compaction response of the region of work material, said electronic controller further being configured to trigger a compaction fault condition if the incipient compaction response satisfies aberrant compaction criteria.

18. The machine of claim 17 wherein said electronic controller is further configured to determine a compaction response curve responsively to the plurality of input signals.

19. The machine of claim 18 wherein:

said compaction response curve is a relative compaction versus number of compactor passes curve;

said electronic controller is configured to compare values associated with the sensor inputs with corresponding values on said compaction response curve, and to determine a slope of an initial segment of said compaction response curve;

said electronic controller is further configured to trigger a compaction fault condition responsively to at least one of, a comparison of the values associated with the sensor inputs with the corresponding values and the slope of the initial segment of the compaction response curve, and configured to trigger a compaction suitability condition responsively to a compaction fault condition not being triggered; and said electronic controller is further configured to generate an operator perceptible signal, responsively to at least one of a triggered fault condition and a triggered compaction suitability condition.

20. An electronic controller for a compactor machine configured to determine an incipient compaction response of a region of a work material based on a plurality of compaction state sensor inputs, and further configured to trigger a compaction fault condition if the incipient compaction response satisfies aberrant compaction criteria.

* * * * *

UNITED STATES PATENT AND TRADEMARK OFFICE

CERTIFICATE OF CORRECTION

PATENT NO. : 7,623,951 B2
APPLICATION NO. : 11/399174
DATED : November 24, 2009
INVENTOR(S) : Congdon et al.

It is certified that error appears in the above-identified patent and that said Letters Patent is hereby corrected as shown below:

Column 8, line 4, delete "Y=a In(x)+b;" and insert -- Y=aIn(x)+b; --.

Column 16, line 7, in Claim 4, delete "fining" and insert -- fitting --.

Column 16, line 10, in Claim 5, delete "fining" and insert -- fitting --.

Column 16, line 42, in Claim 10, delete "fining" and insert -- fitting --.

Column 16, line 43, in Claim 10, delete "fining" and insert -- fitting --.

Signed and Sealed this

Sixteenth Day of March, 2010

David J. Kappos

David J. Kappos
*Director of the United States Patent and Trademark Office*